US009174110B2

(12) United States Patent
Bittner

(10) Patent No.: US 9,174,110 B2
(45) Date of Patent: Nov. 3, 2015

(54) ROBOTIC PUTTING SYSTEM

(71) Applicant: Norman Douglas Bittner, St. Helena Island, SC (US)

(72) Inventor: Norman Douglas Bittner, St. Helena Island, SC (US)

( * ) Notice: Subject to any disclaimer, the term of this patent is extended or adjusted under 35 U.S.C. 154(b) by 0 days.

(21) Appl. No.: 14/162,419

(22) Filed: Jan. 23, 2014

(65) Prior Publication Data

US 2014/0206468 A1 Jul. 24, 2014

Related U.S. Application Data

(60) Provisional application No. 61/755,877, filed on Jan. 23, 2013.

(51) Int. Cl.

| | |
|---|---|
| ***A63B 69/36*** | (2006.01) |
| *A63B 71/06* | (2006.01) |
| *A63B 71/02* | (2006.01) |

(52) U.S. Cl.

CPC ..... *A63B 69/3676* (2013.01); *A63B 69/3644* (2013.01); *A63B 2071/026* (2013.01); *A63B 2071/0694* (2013.01)

(58) Field of Classification Search

CPC ..... A63B 69/04; A63B 69/36; A63B 63/08; A63B 69/08

USPC ..... 473/145, 150, 208, 229, 258, 260, 257, 473/264, 265, 259, 261, 262, 263

See application file for complete search history.

(56) References Cited

U.S. PATENT DOCUMENTS

| | | | | | |
|---|---|---|---|---|---|
| 2,084,901 | A * | 6/1937 | Eisenberg | 473/229 |
| 2,084,902 | A * | 6/1937 | Eisenberg | 473/229 |
| 2,609,199 | A * | 9/1952 | Koener | 473/132 |
| 2,641,933 | A * | 6/1953 | Van Kinkle | 473/146 |
| 3,262,705 | A * | 7/1966 | Nunziato | 473/238 |
| 3,424,462 | A * | 1/1969 | Driscoll | 473/238 |
| 3,471,155 | A * | 10/1969 | Donaldson | 473/260 |
| 4,634,131 | A * | 1/1987 | Vella et al. | 473/229 |
| 4,758,000 | A * | 7/1988 | Cox | 473/208 |
| 4,789,158 | A * | 12/1988 | Chiesa | 473/238 |
| 4,953,867 | A * | 9/1990 | Rigsby | 473/238 |
| 5,125,844 | A * | 6/1992 | Grant et al. | 434/252 |
| 5,282,627 | A * | 2/1994 | Beck | 473/260 |
| 5,393,065 | A * | 2/1995 | LeQuyea | 473/260 |
| 5,527,041 | A * | 6/1996 | Terry et al. | 473/150 |
| 5,586,945 | A * | 12/1996 | Vonderhaar | 473/258 |
| 5,797,804 | A * | 8/1998 | Chen | 473/260 |
| 6,146,283 | A * | 11/2000 | Ferguson, III | 473/145 |
| 6,159,106 | A * | 12/2000 | Adams | 473/265 |
| 6,855,065 | B1 * | 2/2005 | Hamilton | 473/258 |
| 6,893,356 | B2 * | 5/2005 | Thompson | 473/257 |
| 7,160,201 | B2 * | 1/2007 | Dahl | 473/265 |
| 7,172,516 | B2 * | 2/2007 | Wu | 473/264 |
| 7,806,780 | B1 * | 10/2010 | Plunkett | 473/257 |
| 8,267,812 | B1 * | 9/2012 | Sery | 473/409 |

(Continued)

FOREIGN PATENT DOCUMENTS

GB 2308073 A * 6/1997 ..... A63B 69/36

*Primary Examiner* — Melba Bumgarner
*Assistant Examiner* — Ryan Kelly
(74) *Attorney, Agent, or Firm* — Nixon & Vanderhye P.C.

(57) ABSTRACT

A robotic putting system includes a mechanism for actively and physically guiding a putter head along a determined preferred putting path. The golfer need only hold the putter and allow the robotic mechanism to guide the motion of the putter head. The system enables a golfer to develop and practice a feel for the preferred path/stroke.

6 Claims, 10 Drawing Sheets

(56) References Cited

U.S. PATENT DOCUMENTS

| | | | | |
|---|---|---|---|---|
| 8,337,321 | B2 * | 12/2012 | Bittner | 473/265 |
| 8,579,720 | B2 * | 11/2013 | Bittner | 473/265 |
| 2006/0128492 | A1 * | 6/2006 | Hourihan et al. | 473/257 |
| 2006/0141434 | A1 * | 6/2006 | Moran, Jr. | 434/252 |
| 2007/0238542 | A1 * | 10/2007 | Pecue | 473/257 |
| 2009/0082122 | A1 * | 3/2009 | Kellogg | 473/222 |
| 2009/0088266 | A1 * | 4/2009 | McInerney | 473/226 |
| 2012/0157218 | A1 * | 6/2012 | Bittner | 473/220 |
| 2013/0331195 | A1 * | 12/2013 | Sery | 473/223 |
| 2014/0065586 | A1 * | 3/2014 | Gabbai | 434/247 |
| 2014/0206468 | A1 * | 7/2014 | Bittner | 473/260 |

* cited by examiner

ROBOTIC PUTTING SYSTEM

CROSS-REFERENCES TO RELATED APPLICATIONS

This application claims the benefit of U.S. Provisional Patent Application Ser. No. 61/755,877, filed Jan. 23, 2013, the entire content of which is herein incorporated by reference.

STATEMENT REGARDING FEDERALLY SPONSORED RESEARCH OR DEVELOPMENT (Not Applicable)

BACKGROUND OF THE INVENTION

The invention relates generally to a robotic device for a putting stroke and, more particularly, to a robotic device that facilitates training a player to perfect a personalized preferred putting path.

The invention relates to pending U.S. patent application Ser. No. 13/680,833 (now U.S. Pat. No. 8,579,720) and the applications from which it claims priority, the contents of all of which are hereby incorporated by reference. In that family of inventions, structure and methods are described to assist a golfer in identifying a preferred putting path. It is recognized that there is not one "perfect" path for all golfers with regard to a putting stroke, particularly with amateur golfers, but rather there is a preferred path for each individual golfer that gives that golfer the best chance for a successful putt. The system and methods in the pending patent family facilitate the identification of the golfer's preferred putting path and provide vehicles to assist the golfer in putting consistently on the preferred path.

Touch sensitive or proximity sensitive computer screens and the like along with sensors on the putter itself are used to determine a golfer's preferred putting path, i.e., a path for the golfer that is most likely to achieve a successful result. Once the preferred path is determined, the path can be marked or displayed on a grid box floor, which the golfer can take to the practice putting green. Additional features of the invention family may include sensors and alarms cooperable with the grid box that signal when the golfer deviates from the preferred putting path during a putt. The grid box may also be provided with a flexible wall that can be positioned to guide the golfer in following the preferred putting path and to develop muscle memory.

BRIEF SUMMARY OF THE INVENTION

The robotic putting system of the invention provides a mechanism for actively and physically guiding the putter head along the determined preferred putting path. The golfer need only hold the putter and allow the robotic mechanism to guide the motion of the putter head so that the player can develop and practice a feel for the preferred path/stroke.

In an exemplary embodiment, a robotic putting system includes a housing defining a space for a putter head to make a putting stroke, and an operating mechanism cooperable with the housing. The operating mechanism includes a servo motor connected to a worm gear and a carriage mechanism mounted on the worm gear. The carriage mechanism has a hosel clamp extending through the housing and securable to a hosel of the putter. An X-component template cooperable with the carriage mechanism is configured to control a horizontal position of the hosel clamp as the carriage mechanism is displaced back and forth by the worm gear. Additionally, a Y-component template cooperable with the carriage mechanism is configured to control vertical movement of the hosel clamp as the carriage mechanism is displaced back and forth by the worm gear.

The carriage mechanism may include a carriage frame supporting a vertical guide that is horizontally displaceable in the carriage frame, and the carriage mechanism may include a putter carriage mounted on the vertical guide and vertically displaceable on the vertical guide. The hosel clamp is coupled with the putter carriage.

The Y-component template may be connected to a wall of the housing. The X-component template and the Y-component template may be interchangeable with alternative X-component and Y-component templates.

The X-component template may include an X-component cam slot, where the hosel clamp is disposed in the cam slot and acts as a first cam follower. The Y-component template may include a Y-component cam slot, where the carriage mechanism includes a second cam follower disposed in the Y-component cam slot. The X-component cam slot and the Y-component cam slot may be customized according to a golfer's preferred putting path.

BRIEF DESCRIPTION OF THE DRAWINGS

These and other aspects and advantages will be described in detail with reference to the accompanying drawings, in which.

DETAILED DESCRIPTION OF THE INVENTION

Figure 2:
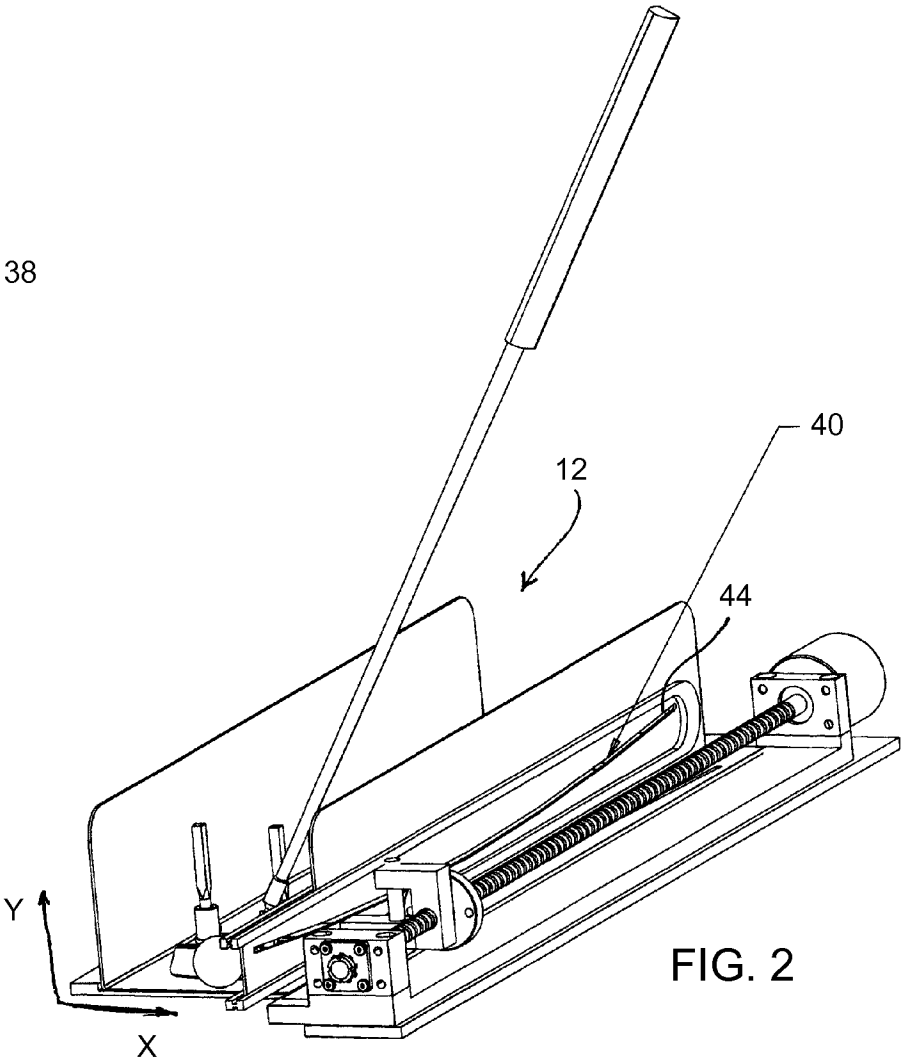
FIGS. 1-3 are perspective views of the robotic putting system.
Figure 1:
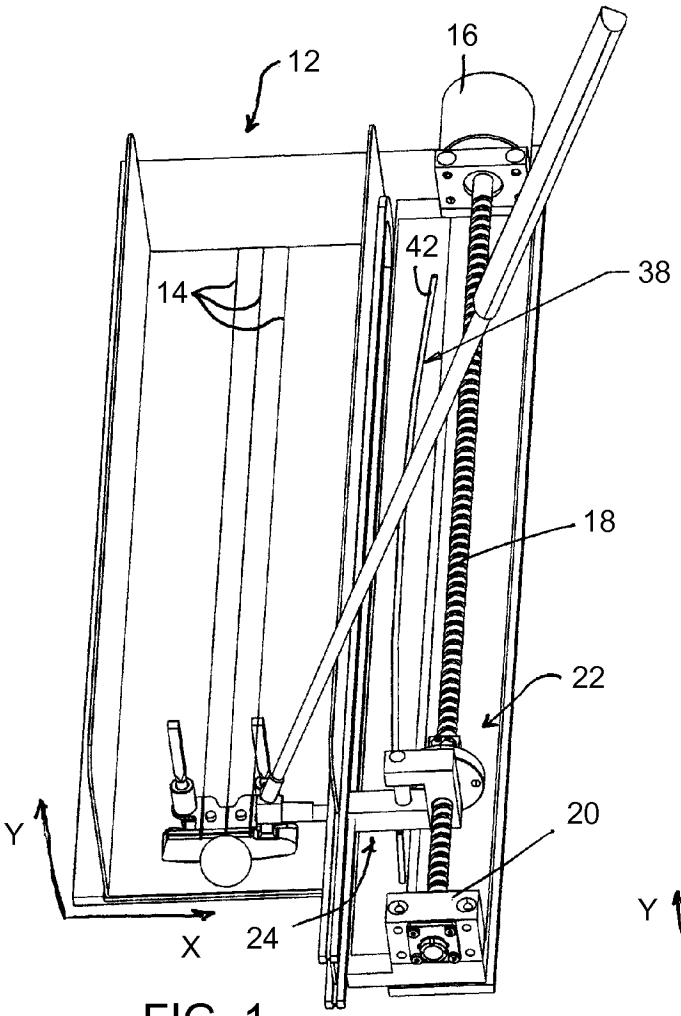
Figure 3:
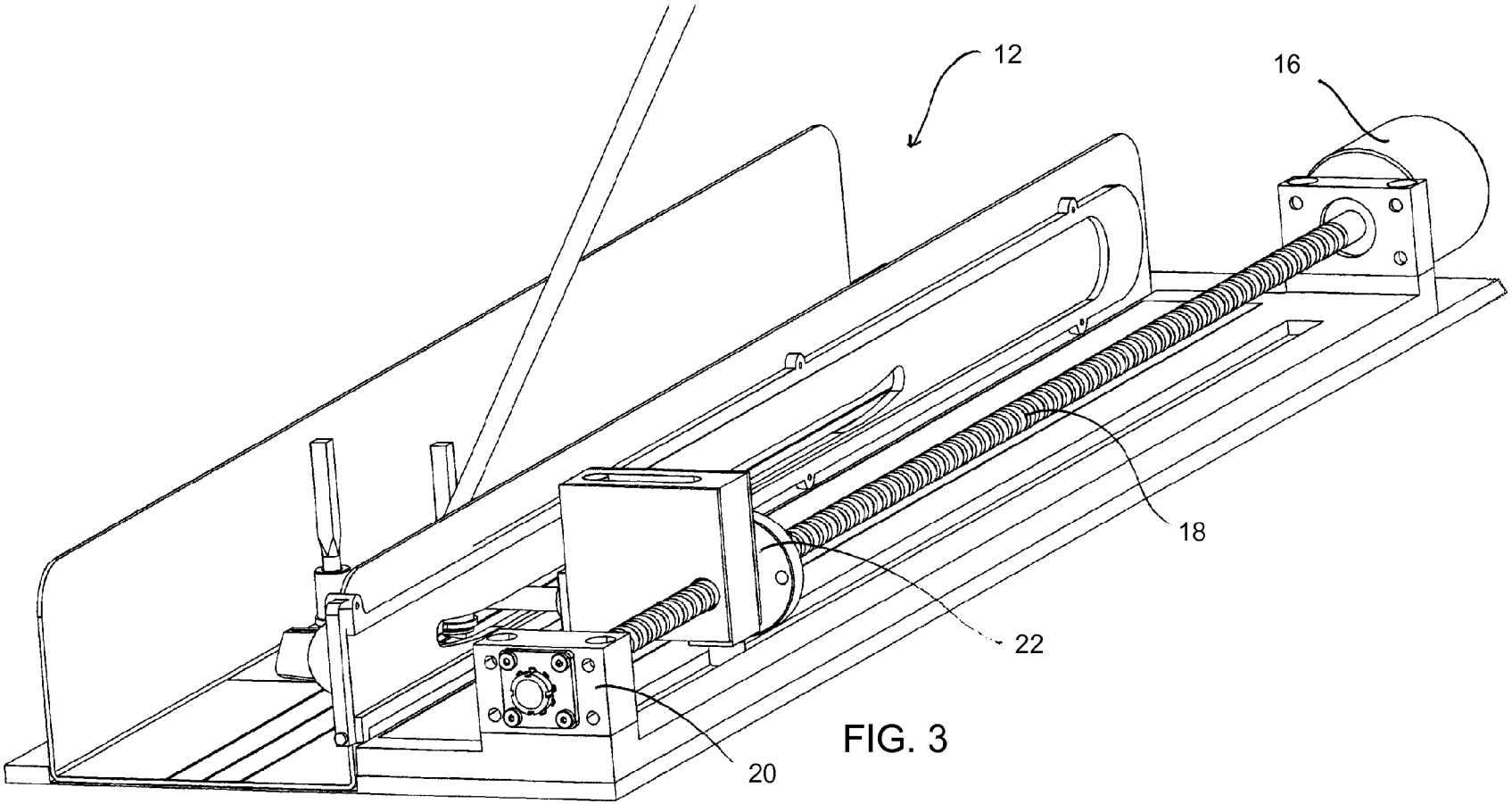

FIGS. 1-3 are perspective views of the robotic training system. A housing 12 defines a space for the putter head to make a putting stroke. The housing floor may include alignment lines 14 that are cooperable with corresponding lines attached to a top surface of the putter head. The alignment lines 14 may alternatively be aligned with the preferred putting path as determined according to the noted family of patent applications.

The operating mechanism includes a servo motor 16 connected to a worm gear/screw 18, which in turn is secured to a bearing housing 20. A carriage 22 is connected with the worm gear 18 and is displaced back and forth along the worm gear 18 by operation of the servo motor 16.

Figures 4, 5:
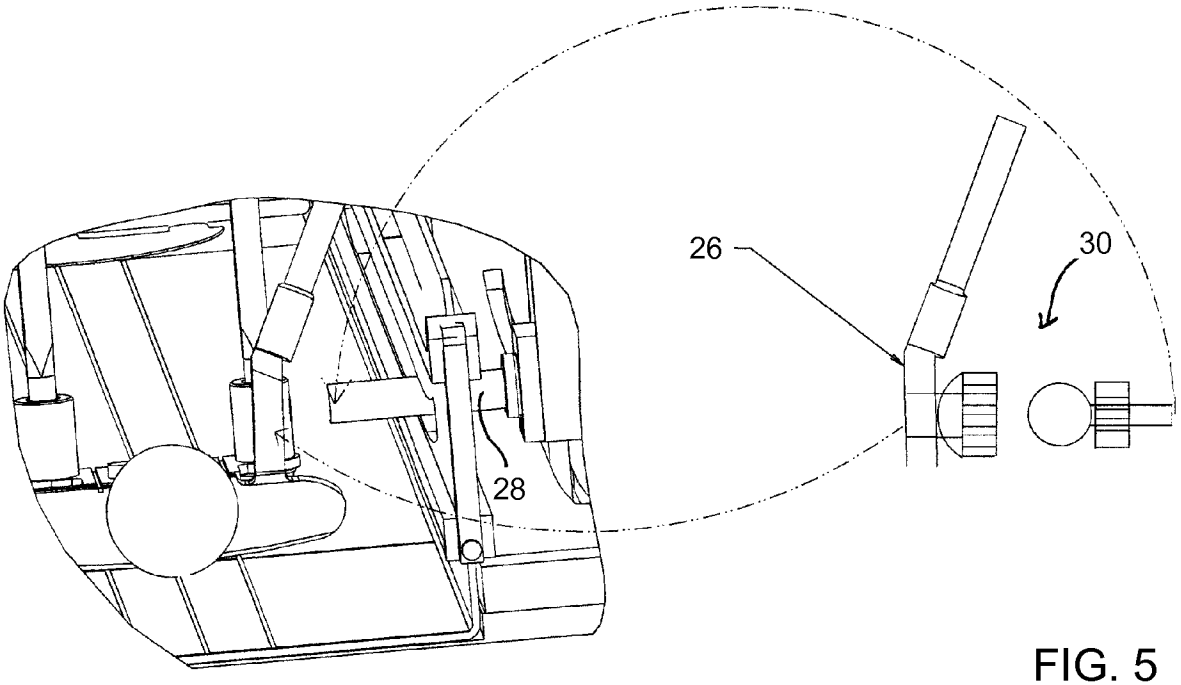
FIG. 4 is a close-up view of the hosel connector.
FIG. 5 shows a ball and socket joint cooperable with the hosel connector.

The carriage 22 supports a hosel clamp 24, which is attachable to the hosel 26 of the putter head. With reference to FIGS. 4 and 5, a shaft 28 of the hosel connector 26 extends through a wall of the housing 12 and terminates in a ball and socket joint 30. The ball and socket joint 30 can facilitate any putter placement until tightened. The joint has a quick tighten/release lever to hold the putter in position.

Figure 6:
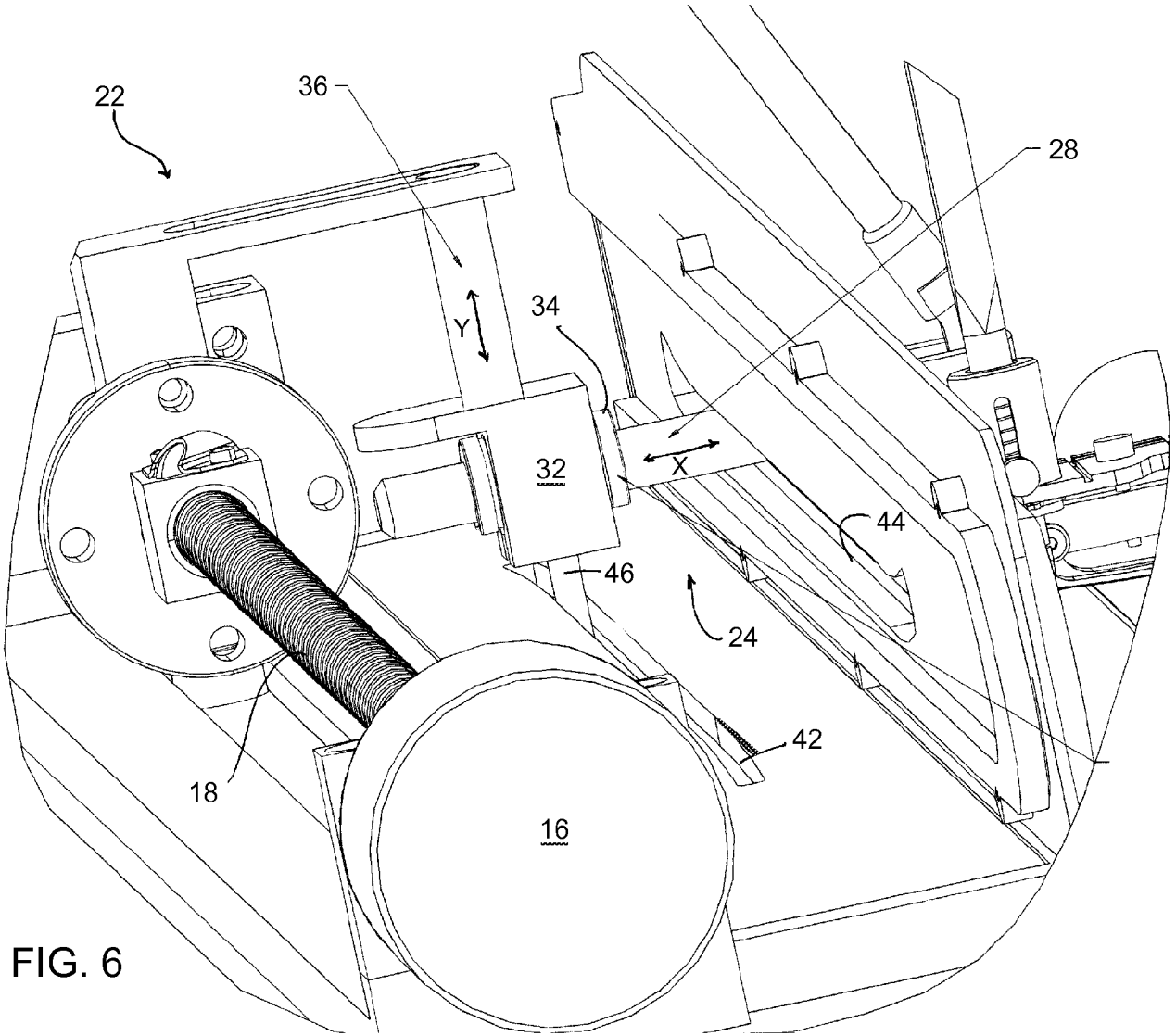
FIG. 6 is a detailed view of the carriage mechanism and the hosel clamp.

FIG. 6 shows a detailed view of the carriage mechanism 22 and the hosel clamp 24. A putter carriage 32 coupled with the carriage mechanism 22 accommodates displacement of the putter head in an X-Y plane during operation of the worm gear 18. The putter carriage 32 includes a low friction bearing that receives the shaft 28 for displacement of the putter head horizontally (see arrow X in FIG. 6). The putter carriage 32 also accommodates a vertical guide 36 over which the putter carriage 32 is displaceable in a vertical direction (see arrow Y in FIG. 6).

Referring again to FIGS. 1 and 2, in order to guide the putter head along the preferred putting path, two templates 38, 40 are produced based on the X and Y components of the preferred putting path, respectively. The X component template 38 controls a horizontal position of the putter head (X direction) as the carriage 22 is moved back and forth by the worm gear 18. A Y component template 40 (FIG. 2) controls vertical movement of the putter head (Y direction) during the putting stroke. Each of the templates 38, 40 includes a corresponding cam slot 42, 44 in which a cam follower coupled with the putter carriage 32 is engaged. As shown in FIG. 6, the putter carriage 32 includes a cam follower or pin guide 46 engaging the cam slot 42 in the X component template 38, and the shaft or horizontal guide 28 extends through the cam slot 44 in the Y component template 40.

The templates 38, 40 are customized for each golfer depending on the golfer's preferred putting path. The templates 38, 40 are easily insertable and removable in corresponding template slots. Other characteristics of the golfer's preferred stroke are also taken into account, including, without limitation, speed of drawback, length of drawback relative to distance of putt, putter characteristics (weight of putter, balance, putter type, etc.), etc. In this manner, the system can be customized for each golfer according to the golfer's unique preferred putting path. The golfer learns the feel of a successful putt including how hard to strike the ball based on putting distance, how far back to draw club based on putting distance, etc.

Figure 7:
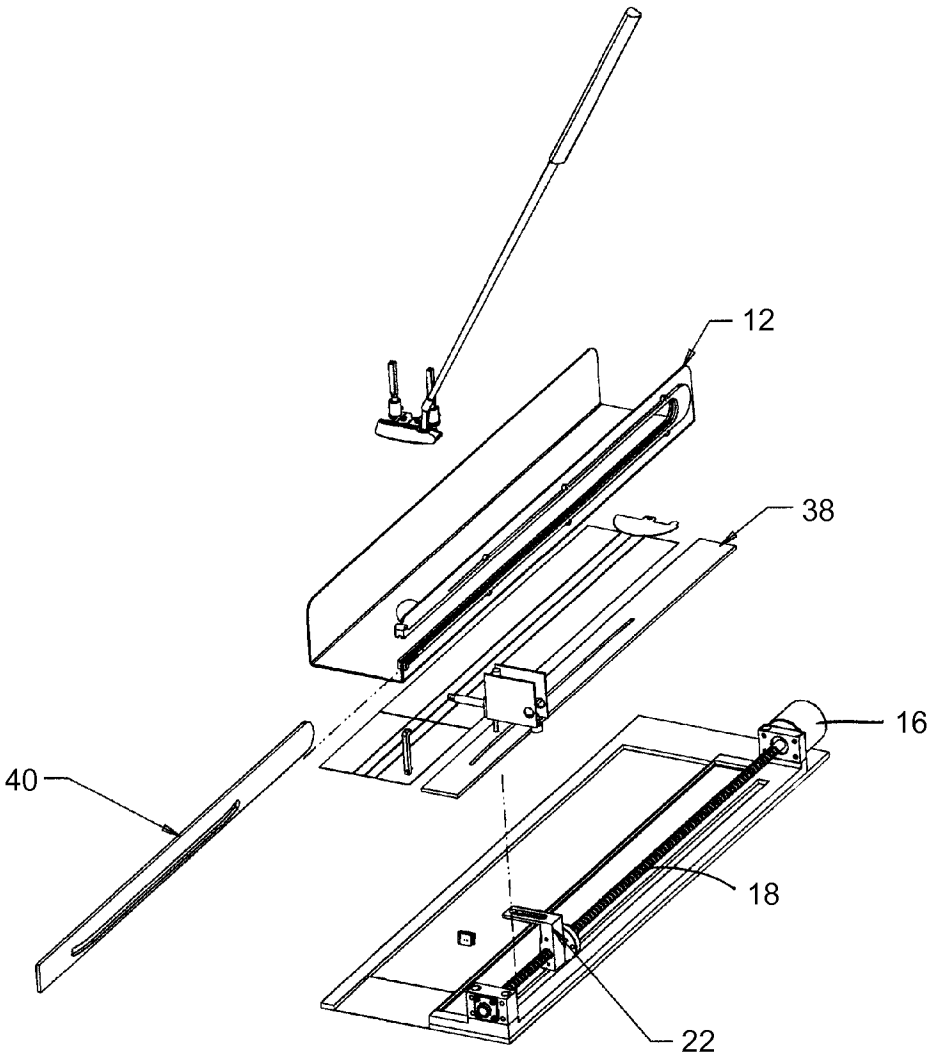
FIG. 7 is an exploded view showing the parts of the robotic putting mechanism.
Figure 8:
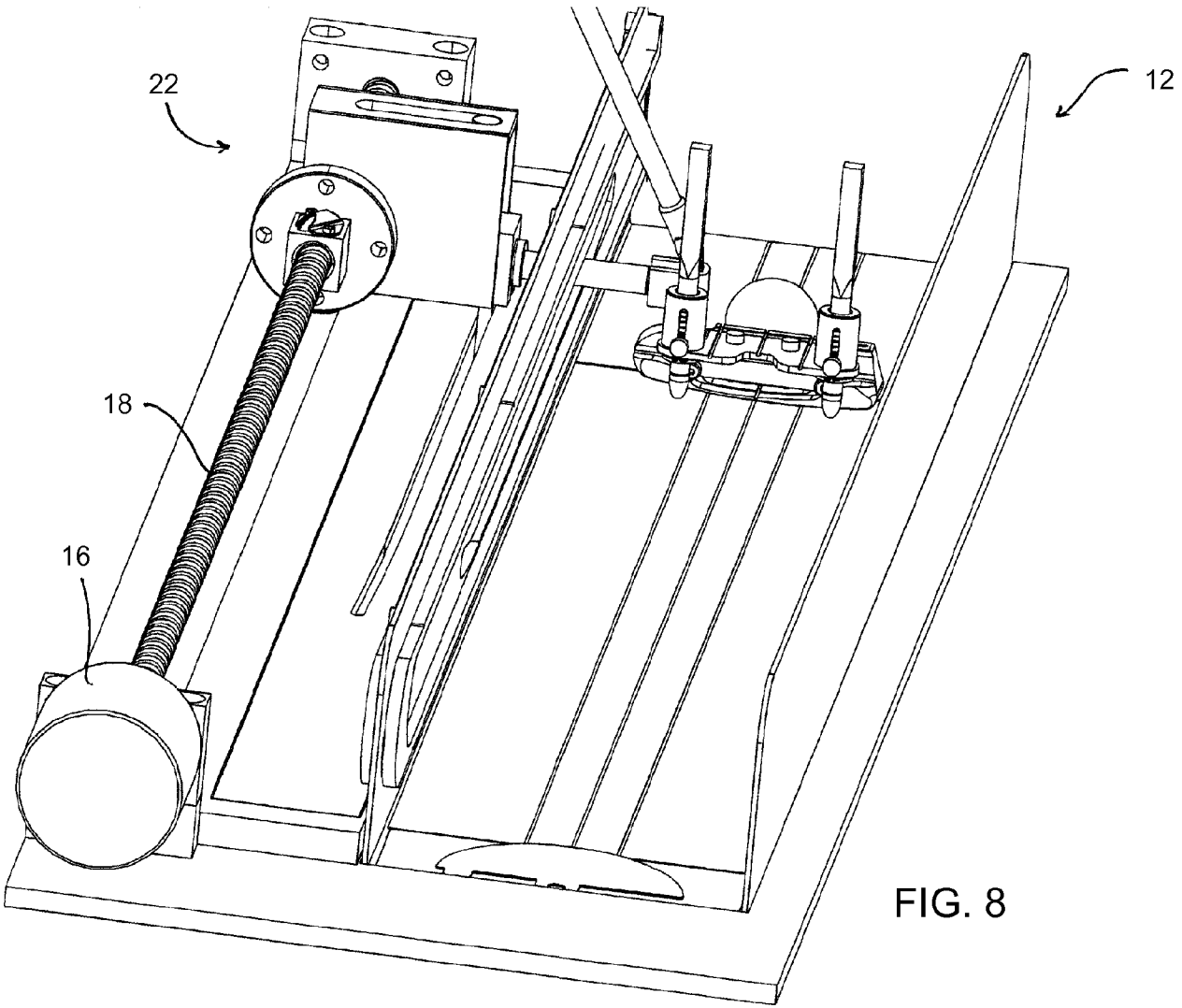
FIGS. 8-13 show various views of the assembly.
Figure 9:
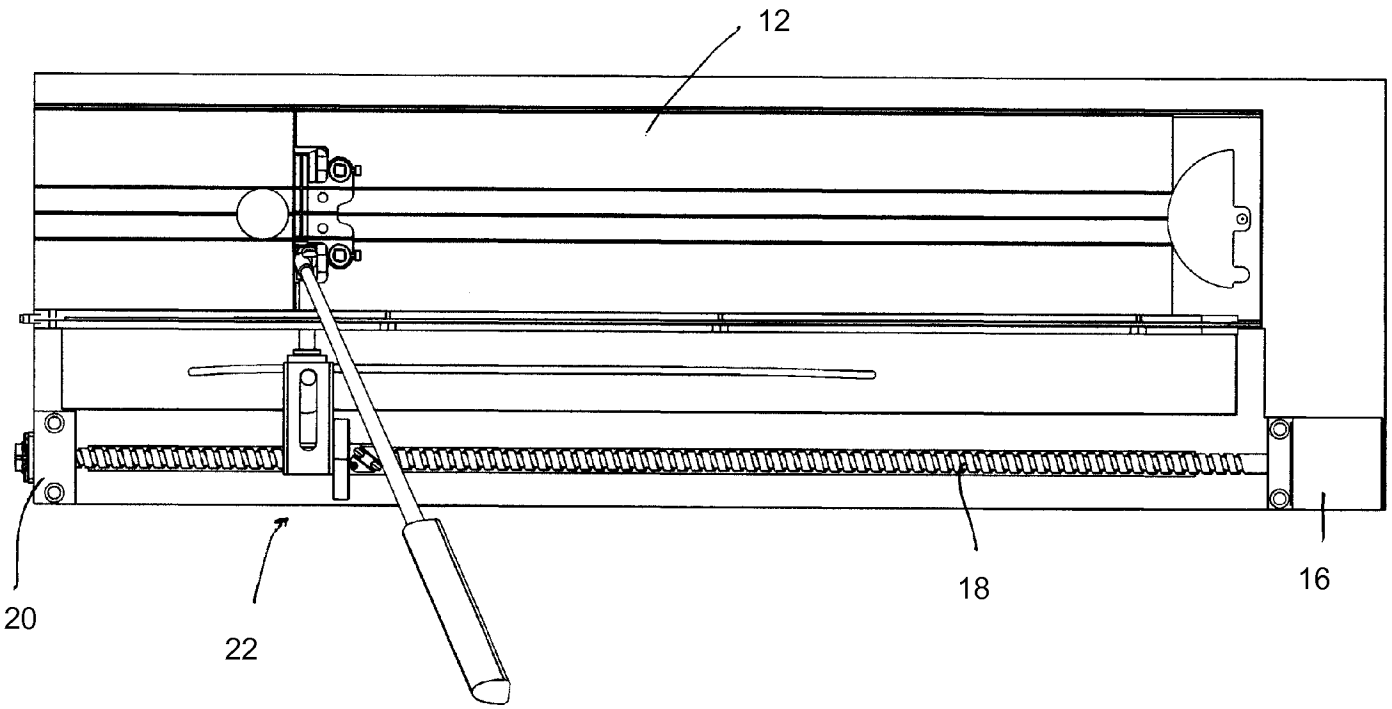
Figure 10:
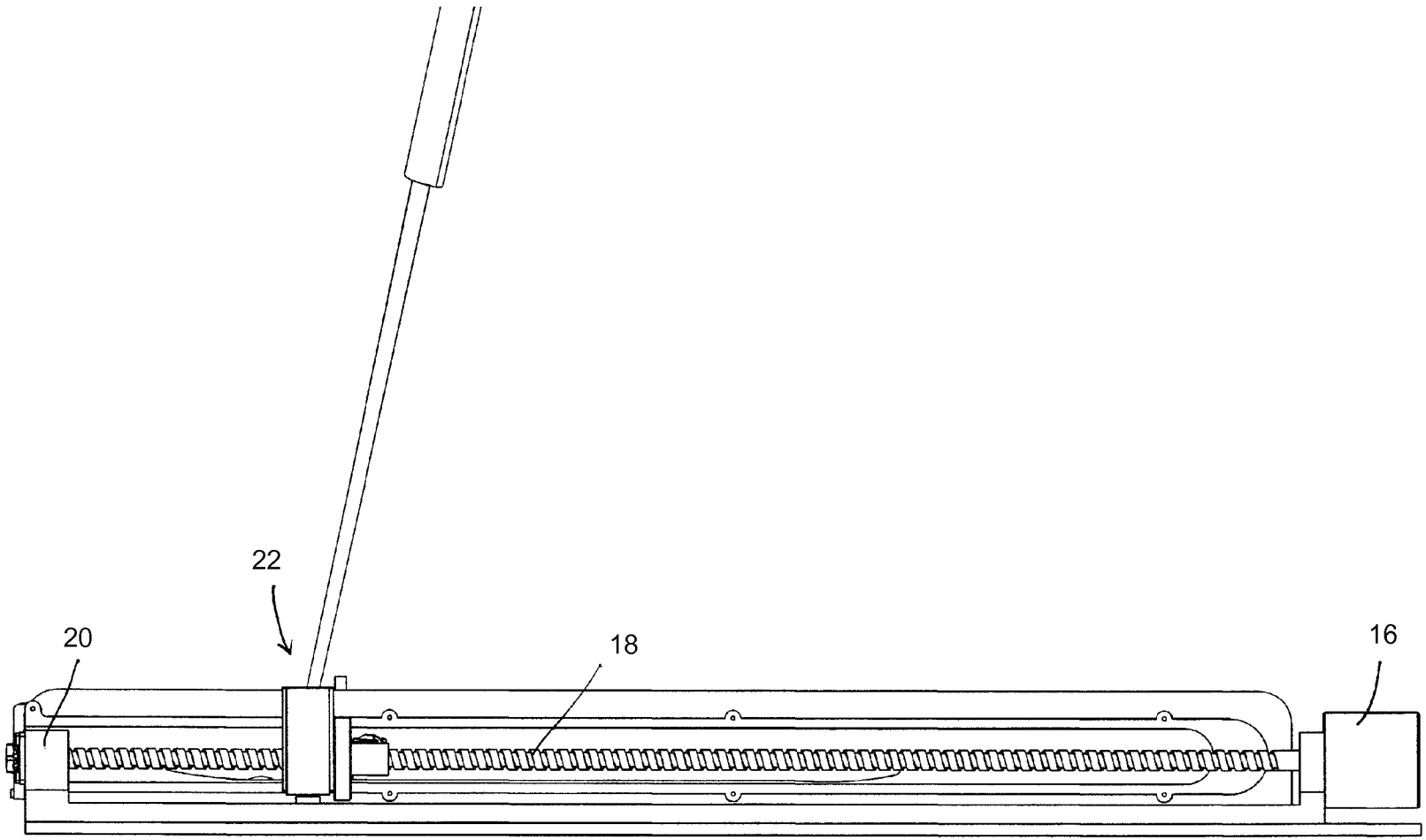
Figure 11:
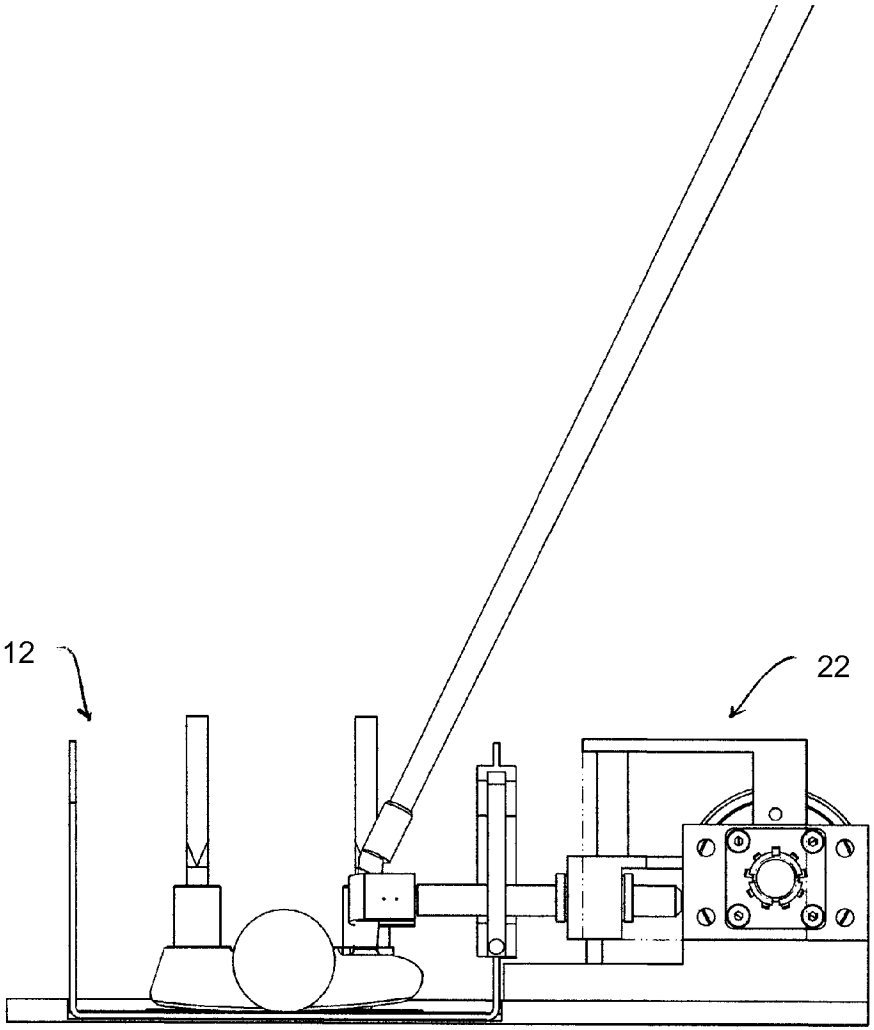
Figure 12:
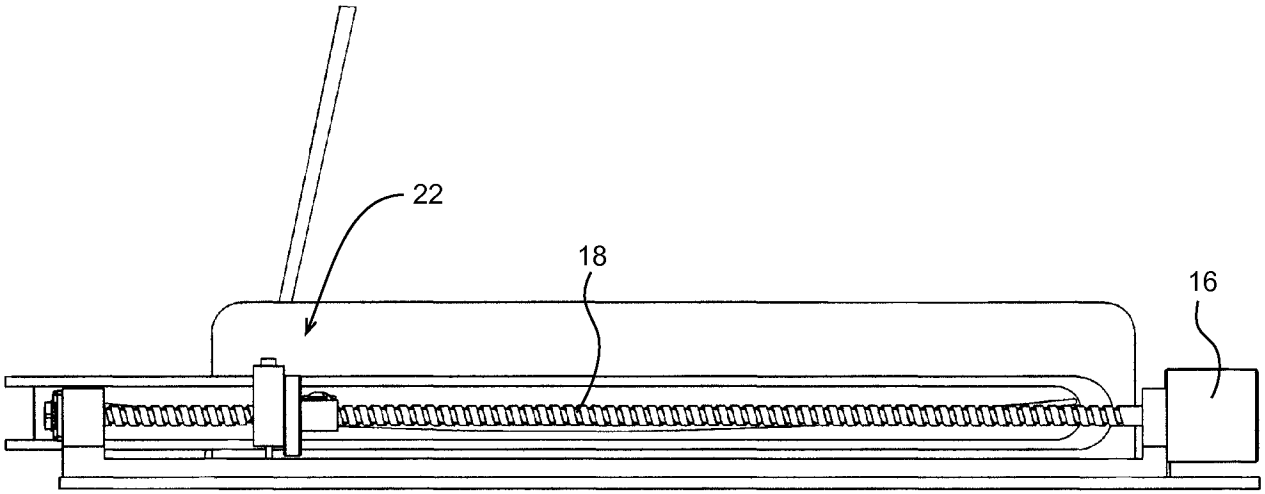
Figure 13:
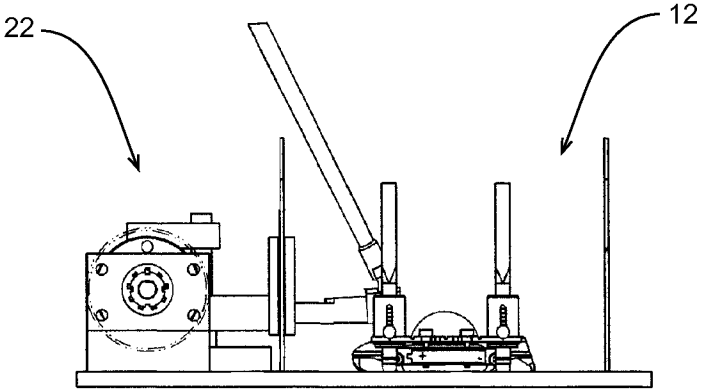

FIG. 7 is an exploded view showing the parts of the robotic putting mechanism. FIGS. 8-13 show various views of the assembly. FIG. 13 shows a battery pack that forms part of an attachment securable to the putter head. As described in the noted family of patent applications, the battery pack may be used to power diodes that are responsive to optical sensors that determine whether the putter head is following a line or series of lines imprinted on the housing floor. As described in alternative embodiments, the battery pack may instead be positioned in the handle of the golf club. The attachment supporting the battery pack can be removed for use with the robotic mechanism.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A robotic putting system comprising:

a housing defining a space for a putter head to make a putting stroke;

an operating mechanism cooperable with the housing, the operating mechanism including a servo motor connected to a worm gear, and a carriage mechanism mounted on the worm gear, the carriage mechanism including a hosel clamp extending through the housing and securable to a hosel of the putter, wherein the carriage mechanism is displaceable back and forth by the worm gear;

an X-component template cooperable with the carriage mechanism and configured to actively control a horizontal position of the hosel clamp as the carriage mechanism is displaced back and forth by the worm gear, wherein the horizontal position of the hosel clamp is perpendicular to the back and forth displacement of the carriage mechanism; and a Y-component template cooperable with the carriage mechanism and configured to control vertical movement of the hosel clamp as the carriage mechanism is displaced back and forth by the worm gear, wherein the X-component template comprises an X-component cam slot, wherein the hosel clamp is disposed in the cam slot and acts as a first cam follower, wherein the Y-component template comprises a Y-component cam slot, and wherein the carriage mechanism comprises a second cam follower disposed in the Y-component cam slot.

2. A robotic putting system according to claim 1, wherein the carriage mechanism comprises a carriage frame supporting a vertical guide that is horizontally displaceable in the carriage frame, and wherein the carriage mechanism comprises a putter carriage mounted on the vertical guide and vertically displaceable on the vertical guide, wherein the hosel clamp is coupled with the putter carriage.

3. A robotic putting system according to claim 1, wherein the Y-component template is connected to a wall of the housing.

4. A robotic putting system according to claim 1, wherein the X-component template and the Y-component template are interchangeable with alternative X-component and Y-component templates.

5. A robotic putting system according to claim 1, wherein the X-component cam slot and the Y-component cam slot are customized according to a golfer's preferred putting path.

6. A robotic putting system comprising:

a housing defining a space for a putter head to make a putting stroke;

an operating mechanism cooperable with the housing, the operating mechanism including a servo motor connected to a worm gear, and a carriage mechanism mounted on the worm gear, the carriage mechanism including a hosel clamp extending through the housing and securable to a hosel of the putter;

an X-component template cooperable with the carriage mechanism and including an X-component cam slot, wherein the hosel clamp is disposed in the cam slot and acts as a first cam follower as the carriage mechanism is displaced back and forth by the worm gear; and a Y-component template cooperable with the carriage mechanism and including a Y-component cam slot, wherein the carriage mechanism comprises a second cam follower disposed in the Y-component cam slot configured to control vertical movement of the hosel clamp as the carriage mechanism is displaced back and forth by the worm gear.

* * * * *